United States Patent [19]

Bardini

[11] Patent Number: 4,873,739

[45] Date of Patent: Oct. 17, 1989

[54] CHIMNEY CLEANING DEVICE

[76] Inventor: Armando J. Bardini, 136 Hanley Dr., Grass Valley, Calif. 95945

[21] Appl. No.: 177,601

[22] Filed: Apr. 5, 1988

[51] Int. Cl.[4] ..... F23J 3/00

[52] U.S. Cl. ..... 15/242; 15/243

[58] Field of Search ..... 15/162, 163, 242, 243, 15/249, 104.16, 104.18

[56] References Cited

U.S. PATENT DOCUMENTS

| | | | |
|---|---|---|---|
| 731,190 | 6/1903 | Kuhlman | 15/242 |
| 4,138,758 | 2/1979 | Dodge et al. | 15/243 |
| 4,562,608 | 1/1986 | Weir | 15/163 |

FOREIGN PATENT DOCUMENTS

| | | | |
|---|---|---|---|
| 1147512 | 6/1983 | Canada . | |
| 87954 | 7/1895 | Fed. Rep. of Germany . | |
| 2155733 | 5/1973 | Fed. Rep. of Germany | 15/243 |
| 33 | 1/1886 | United Kingdom | 15/242 |

*Primary Examiner*—Peter Feldman

[57] ABSTRACT

This invention relates to two or more flat flexible membranes segmented into blades for cleaning chimneys and conduits. Said membranes can be lowered into a chimney by gravity and with only light contact with the interior surface of the chimney. The blades comprising the membrane are forced into firm and maintained contact, with the interior surface of the chimney when moved through the chimney in the upward direction.

2 Claims, 2 Drawing Sheets

CHIMNEY CLEANING DEVICE

This invention relates to a device for cleaning chimneys and, more specifically, to a pair of segmented and flexible membranes that can move freely into a chimney with light contact with the interior walls in one direction, and with firm contact in the oppposite direction.

Heretofore, chimney cleaning apparatii were usually of the wire bristle brush type which are sized to fit tightly into the chimney to be cleaned. Of the known brush type cleaning devices, there are two general brush configurations. One type consists of wire bristles attached to a central stem with said bristles contacting the entire perimeter of the chimney. The other type is made up of pivoting or hinged rigid brush segments, which pivot in one direction of motion and are restrained in the opposite direction of motion.

Canadian Pat. No. 114757 is of wire bristles attached to a central stem type, U.S. Pat. No. 4,562,608 and Fed. Rep. of Germany Pat. No. 87954 are of the pivoting brush segment type.

The subject invention is simpler in construction and operation than the prior art. The device is adapted to move into a chimney by gravity in one direction of motion and forced contact in the opposite direction.

The flexible membranes which are segmented into individual blades contact and clean the interior surface of the chimney by a scraping action against the surface of the chimney. The blades are configured to deflect at an inner and reduced section of the blade in one direction of motion and deflect at an enlarged section of the blade when moving in the opposite direction. The deflection and/or stiffness is determined by allowing the blades to deflect freely as the device is lowered into the chimney and by reacting with an interposing rigid disc when moved out of the chimney.

The membranes can be shaped to conform to any cross section of a chimney or conduit. The segmented membranes are oriented so that the blade segments of one membrane are directly opposite the voids of the other membrane, thereby insuring that the entire perimeter of the chimney is contacted. The two membranes are secured near the central axis.

The interposing disc on the opposite side of the membrane extends to an outer point of the membrane segments. The individual blades will be forced to bend by either reacting with the interposing disc at the outer point of blades or bend at the center attachment point, depending on the direction of motion of the membrane. When the blades react at the outer point they are forced into firm contact with the chimney surface and when they bend at the inner attachment point the segments move easily out of contact with the walls of the chimney.

With attention to the drawings and the numerals indicating the parts of the preferred embodiment, the invention will be more fully described.

Figure 1:
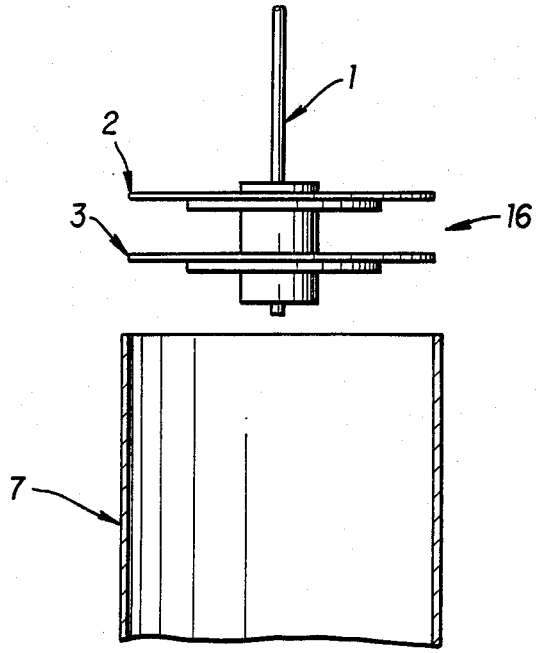
FIG. 1 Shows the chimney cleaning device positioned to enter a chimney or conduit of any cross sectional shape or size.

With reference to FIG. 1, the cleaning device of the preferred embodiment is generally designated as 17 and the conduit or chimney to be cleaned is designated as 18. The cleaning device is suspended by a Cable 1. The cleaning device 17 is comprised of said flexible blade segmented membranes designated 2 and 3. The interposing discs 4 and 5 and attachment hubs 6, 7 and 8 provide the selective bending points 13 and 14 in FIG. 2 and 11, 12 in FIG. 3.

Figure 2:
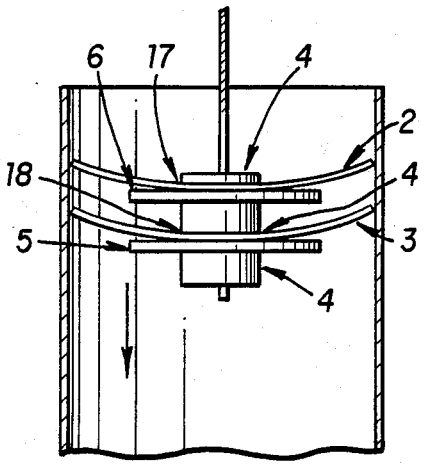
FIG. 2 Shows the cleaning device being lowered into the chimney with blades lightly contacting the walls of the chimney.
Figure 3:
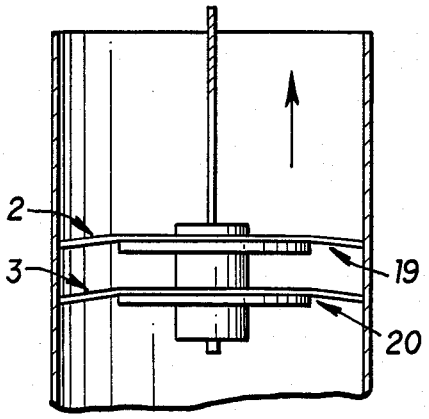
FIG. 3 Shows the cleaning device moving in the reverse or upward direction of the chimney with the blades forced into contact with the walls of the chimney by the interposing discs.

FIG. 2 shows the cleaning device lowering into the chimney with the membrane blade segments bending at points 13 and 14. FIG. 3 shows the cleaning device moving out of the chimney with the membrane blade segments forced into firm contact with the walls of the chimney. The membrane blade segments bend at points 11 and 12, shown in FIG. 3, during the outward motion of the device, producing the predetermined scraping action of the segments on the wall of the chimney.

Figure 4:
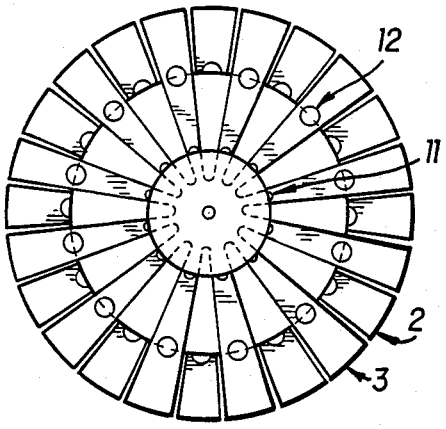
FIG. 4 Shows a plan view of the device and the orientation of the blades comprising the upper and lower flexible circular membranes.
Figure 7:
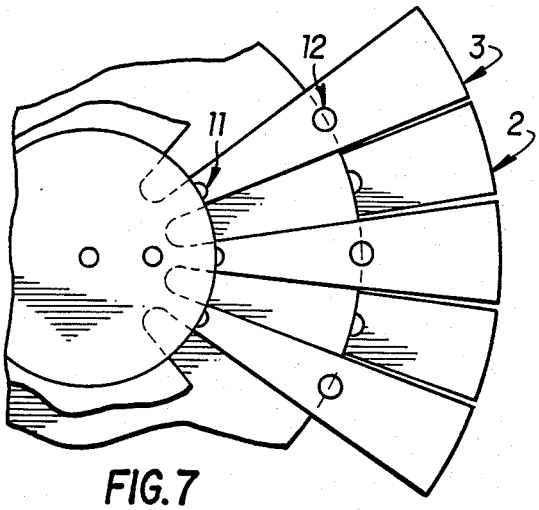
FIG. 7 Shows a detail of the blades with the holes that determine the required flexure at the inner and outer bending points.
Figure 8:
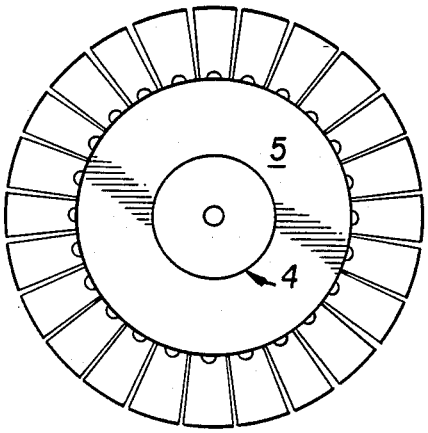
FIG. 8 Shows a bottom view of the cleaning device.

FIG. 4 is a plan view showing the orientation of the upper and lower membrane, segments 2 and 3, respectively. FIG. 7 and FIG. 4 show the membrane blade segments bending section relieved by the holes 9 and 10. The flexure of the blade segments 2 and 3 is predetermined by the size of the holes.

Figure 9:
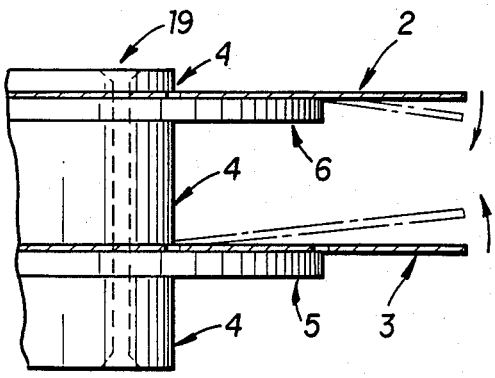
FIG. 9 Shows a detail of how the flexure points of the blades shift as the direction of motion changes.

FIG. 9 illustrates how the bending points of the upper and lower blades alternate from an inner and outer point depending on the direction of motion of the cleaning device as illustrated in FIGS. 2 and 3.

Figure 6:
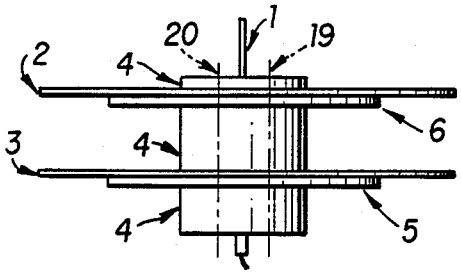
FIG. 6 Shows an elevation view of the cleaning device.

FIG. 6 is an elevation view of the cleaning device which shows the interposing discs 4 and 5 and hubs 6, 7 and 8. The rivets 15 and 16 secure the elements comprising the cleaning device, and in the correct orientation with each other.

FIG. 7 shows that the holes 9 and 10 which predetermine the flexure of the blades, centered at the outer edges of the discs 4 and 5 and at the inner attachment hubs 6 and 7.

Figure 5:
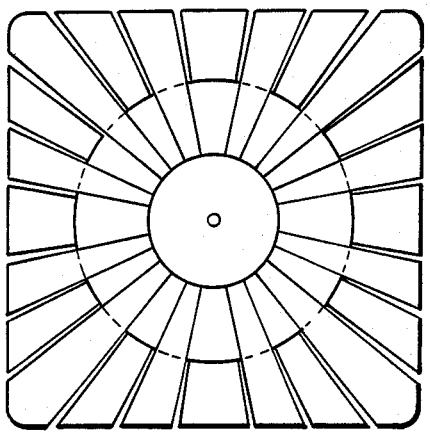
FIG. 5 Shows a plan view of the device and the orientation of the blades comprising the upper and lower flexible membranes for conduit shapes other than circular.

FIG. 5 shows a plan view of alternate pair of segmented membranes designed to conform to non-circular chimneys or conduit.

I claim:

1. A chimney cleaning device adapted to move downwardly into a chimney with reduced contact with the interior walls in one direction and with firm scraping contact with the walls in the opposite direction, the cleaning device comprises two spaced segmented flat membranes, each of said membranes conforming to the shape and size of said chimney, each of said membranes being configured to provide multiple radially extending blade segments, each segment being separated by voids therebetween, each of said membranes being attached between an axially aligned hub member and an axially aligned disc member, said hub members being of a smaller inner diameter and said disc members being of a large outer diameter, said membranes being attached to said hub and disc members one above and parallel to each other, said membranes being oriented so that the blade segments of one membrane are directly above the voids of the other membrane, said two membranes, in combination, contacting the entire inside surfaces of the chimney, the perimeters of said smaller diameter hubs forming a plurality of inner located bending points for each of the blade segments in order to allow said blade segments to bend upwardly when said cleaning device is moved downwardly into said chimney to thereby provide only light contact of said blade segments with the interior walls, the perimeters of said outer larger diameter disc members forming a plurality of further outwardly located bending points for each of said blade segments in order to allow said blade segments to bend downwardly at said outer bending points when said cleaning device is moved upwardly in the opposite direction to thereby provide a more forcible scraping action of said blade segments against the interior walls of the chimney, wherein each of said blade segments is provided with a hole at each of said bending points to relieve the flexure of said blade segments.

2. A chimney cleaning device as in claim 1 wherein each blade segment is configured to provide a progressively increasing cross section away from said hub members.

* * * * *